US009681710B2

(12) United States Patent
Takani

(10) Patent No.: US 9,681,710 B2
(45) Date of Patent: Jun. 20, 2017

(54) SLIDE FASTENER

(71) Applicant: YKK Corporation, Tokyo (JP)

(72) Inventor: Go Takani, Toyama (JP)

(73) Assignee: YKK Corporation (JP)

( * ) Notice: Subject to any disclaimer, the term of this patent is extended or adjusted under 35 U.S.C. 154(b) by 297 days.

(21) Appl. No.: 14/580,576

(22) Filed: Dec. 23, 2014

(65) Prior Publication Data

US 2015/0173462 A1 Jun. 25, 2015

(30) Foreign Application Priority Data

Dec. 25, 2013 (JP) ..... 2013-267607

(51) Int. Cl.
*A44B 19/06* (2006.01)

(52) U.S. Cl.
CPC ..... *A44B 19/06* (2013.01); *Y10T 24/2555* (2015.01)

(58) Field of Classification Search
CPC . A44B 19/06; Y10T 24/2555; Y10T 24/2543; Y10T 24/2545; Y10T 24/2539
See application file for complete search history.

(56) References Cited

U.S. PATENT DOCUMENTS 3,977,051 A * 8/1976 Takamatsu ..... A44B 19/384 24/404
6,378,176 B1 * 4/2002 Scherer ..... A44B 19/38 24/433
6,453,521 B1 * 9/2002 Dischler ..... A44B 19/14 24/403
8,800,118 B2 * 8/2014 Takasawa ..... A44B 19/06 24/401
2006/0000065 A1 * 1/2006 Takasawa ..... A44B 19/06 24/401
2014/0013548 A1 * 1/2014 Takani ..... A44B 19/06 24/387

FOREIGN PATENT DOCUMENTS

WO 2012/127688 A1 9/2012

* cited by examiner

*Primary Examiner* — Robert J Sandy
*Assistant Examiner* — Matthew Sullivan
(74) *Attorney, Agent, or Firm* — Kilpatrick Townsend & Stockton LLP

(57) ABSTRACT

Provided is a slide fastener including: a first fastener stringer that includes a first element row and a first fastener tape, the first element row including a plurality of first elements and one or more second elements; a second fastener stringer that includes a second element row and a second fastener tape, the second element row including one or more second elements; and a slider that is slidable along the first and second element rows. Each of the first element and the second element includes a head coupled to a base via a neck. The base includes an opposite surface that is located at the opposite side of the head. The opposite surface of the second element is positioned farther from the opposed side edge than the opposite surface of the first element. At least two engaged second elements of the first and second element rows constitute a lock unit that is for locking the slider.

18 Claims, 11 Drawing Sheets

SLIDE FASTENER

CROSS-REFERENCE TO RELATED APPLICATION

The present application claims priority of Japanese Patent Application No. 2013-267607, filed on Dec. 25, 2013 and entitled "A slide fastener", the entire contents of which are hereby incorporated by reference.

TECHNICAL FIELD

The present disclosure relates to a slide fastener.

BACKGROUND

The patent literature 1 discloses an arrangement where at least one stop element including a resistance portion that increases sliding resistance by being brought into contact with an inner surface of a slider when the slider is sliding is locally disposed along an element row of a fastener stringer. The paragraph 0145 of the patent literature 1 discloses with reference to its FIG. 5 that "the resistance portion that increases the sliding resistance of the slider 30 is configured by setting the projection height of the projection portion 62*h* in the stopping element 62 so that the chain width of the element row 12 at a position where the stopping element 62 is disposed when the right and left element rows 12 are coupled becomes larger than the minimum interval between the right and left flange portions 36 at a posterior orifice side end of the slider 30".

CITATION LIST

Patent Literature

[Patent Literature 1] United States Patent Application Publication No. US2014/0013548 (International Publication No. 2012/127688)

SUMMARY

The present inventor has discovered a technical problem under the configuration of FIG. 5 in the patent literature 1 that durability of locking for the slider may be not adequate as the stopping element has the projection portion.

According to one exemplary aspect of the present invention, there is provided a slide fastener comprising: a first fastener stringer that comprises a first element row and a first fastener tape, the first element row including a plurality of first elements and one or more second elements, and the first element row being disposed at the opposed side edge of the first fastener tape; a second fastener stringer that comprises a second element row and a second fastener tape, the second element row including one or more second elements, and the second element row being disposed at the opposed side edge of the second fastener tape; and a slider that is slidable along the first and second element rows of the first and second fastener stringers, wherein each of the first element and the second element includes a head coupled to a base via a neck, the base including an opposite surface that is located at the opposite side of the head, and the opposite surface of the second element is positioned farther from the opposed side edge than the opposite surface of the first element in the first fastener stringer or the second fastener stringer, and at least two engaged second elements of the first and second element rows constitute a lock unit that is for locking the slider.

Under such an exemplary configuration, in some embodiments, there is no need to provide the projection for increasing the sliding resistance caused when the projection touches the inner surface of the flange of the slider. Thus, decrease in locking power of the lock unit due to the wear of the projection caused by repeated touching with the inner surface of the slider may be suppressed. In some embodiments, no projection for increasing the sliding resistance when it touches the inner surface of the flange is not required, and thus no projection may be chipped due to external force applied thereto.

In some embodiments, the first fastener stringer may be one of right and left fastener stringers in exemplary embodiments described later. The second fastener stringer may be the other of right and left fastener stringers in exemplary embodiments described later.

In some embodiments, the total width of the engaged second elements included in the lock unit is greater than the total width of the engaged first elements or the total width of the engaged first and second elements. The minimum space between a pair of flanges of the slider is greater than the total width of the engaged first elements or the total width of the engaged first and second elements. The total width of the engaged second elements included in the lock unit is greater than the minimum space between the pair of flanges of the slider.

In some embodiments, the opposite surface of the second element is formed to be substantially flat in its entire surface.

In some embodiments, the opposite surfaces of at least two engaged second elements touch the inner surfaces of a pair of flanges of the slider while said at least two engaged second elements have been pressed into the space between the pair of flanges of the slider, said opposite surfaces respectively touching the inner surfaces face the opposite direction in partially overlapped manner.

In some embodiments, the second element is movable in the space between an upper wing and a lower wing of the slider while at least two engaged second elements has been pressed into the space between a pair of flanges of the slider.

In some embodiments, the opposite surface of the second element is inclined such that the opposite surface extends closer to the head of the second element as the opposite surface extends away from the main surface of the fastener tape.

In some embodiments, the opposite surface of the second element is mirror finished.

According to one aspect of the present invention, adequate durability of locking by a lock unit including a stop element may be obtained.

BRIEF DESCRIPTION OF DRAWINGS

FIG. 3 is a schematic section of a stop element along a line X3-X3 in FIG. 2.

FIG. 4 also schematically illustrates the lower half of the slider.

FIG. 5 also schematically illustrates the lower half of the slider.

In FIG. 10, the stop elements are decorated with a pattern so that the stop elements are distinguishable from the standard elements.

DETAILED DESCRIPTION

Hereinafter, explanation will be made on embodiments of the present invention with reference to drawings. The embodiments are not mutually exclusive and may be combined in any manner by an ordinary skilled person in the art without excess explanation. The synergic effect of such combinations may also be understandable. In principle, duplicative explanations across embodiments shall be omitted.

Terms indicating directions may be suggested as follows solely for the sake of explanation and absolutely not for limiting the scope of the present invention. Front and back direction may correspond and/or match a sliding direction of a slider and/or a length direction of a fastener tape. A slide fastener may be closed by a frontward sliding of a slider and a slide fastener may be opened by a backward sliding of a slider. Right and left direction may correspond and/or match a direction of arrangement for a pair of right and left fastener stringers placed side by side and/or a width direction of a fastener tape. Up and down direction may correspond and/or match a direction of arrangement for upper and lower wings of a slider placed in up and down side by side and/or a direction perpendicular to a main surface of a fastener tape. The above or other words indicating or defining direction may be redefined in light of the following descriptions or claims or drawings.

The First Embodiment

Figure 1:
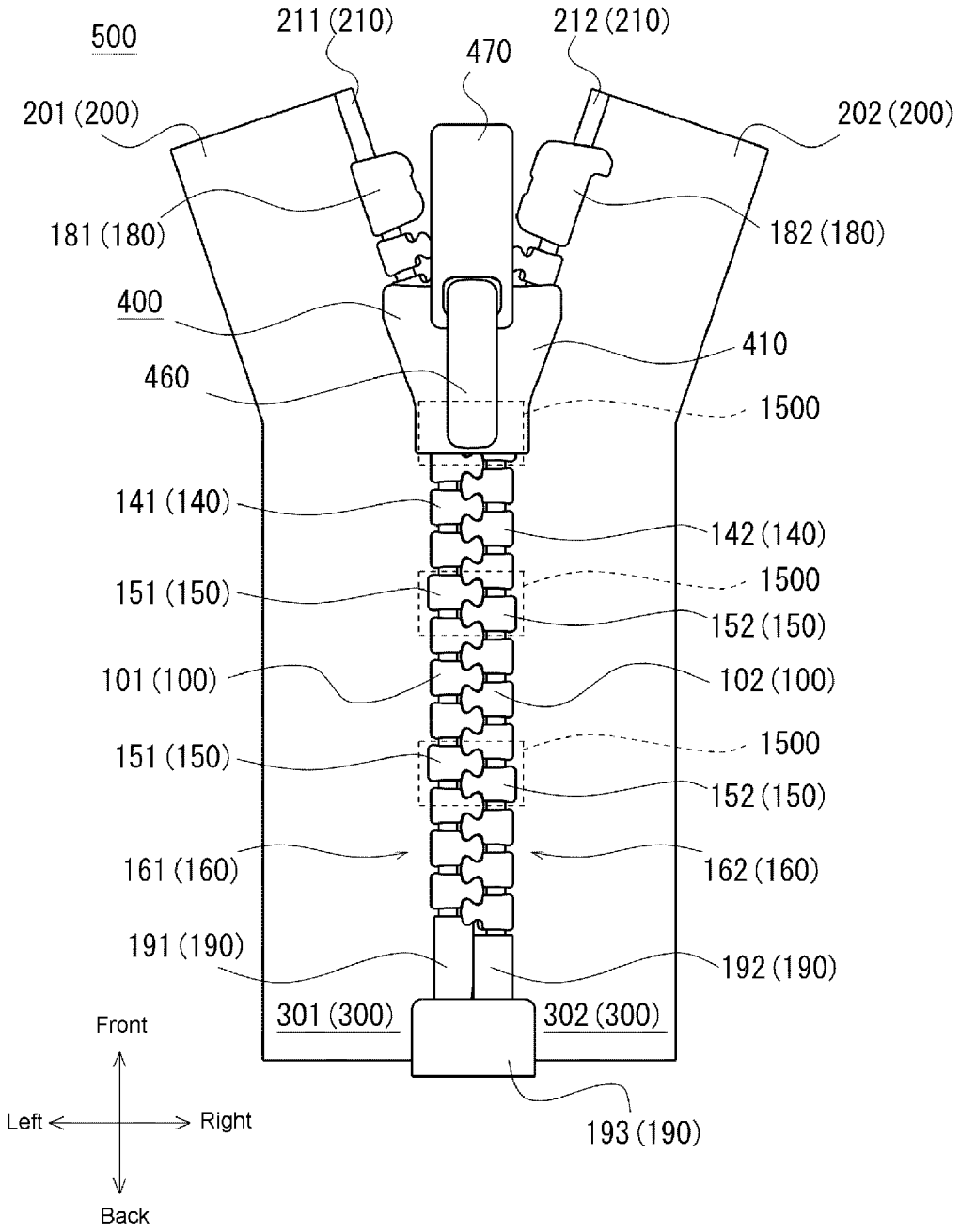
FIG. 1 is a schematic plan view of a slide fastener according to a first embodiment of the present invention where 3 lock units each including interlocked two stop element are provided at an intermediate section between the both ends of element rows extending between a front stop and a back stop in which the lock units are arranged in a mutually separated manner.
Figure 2:
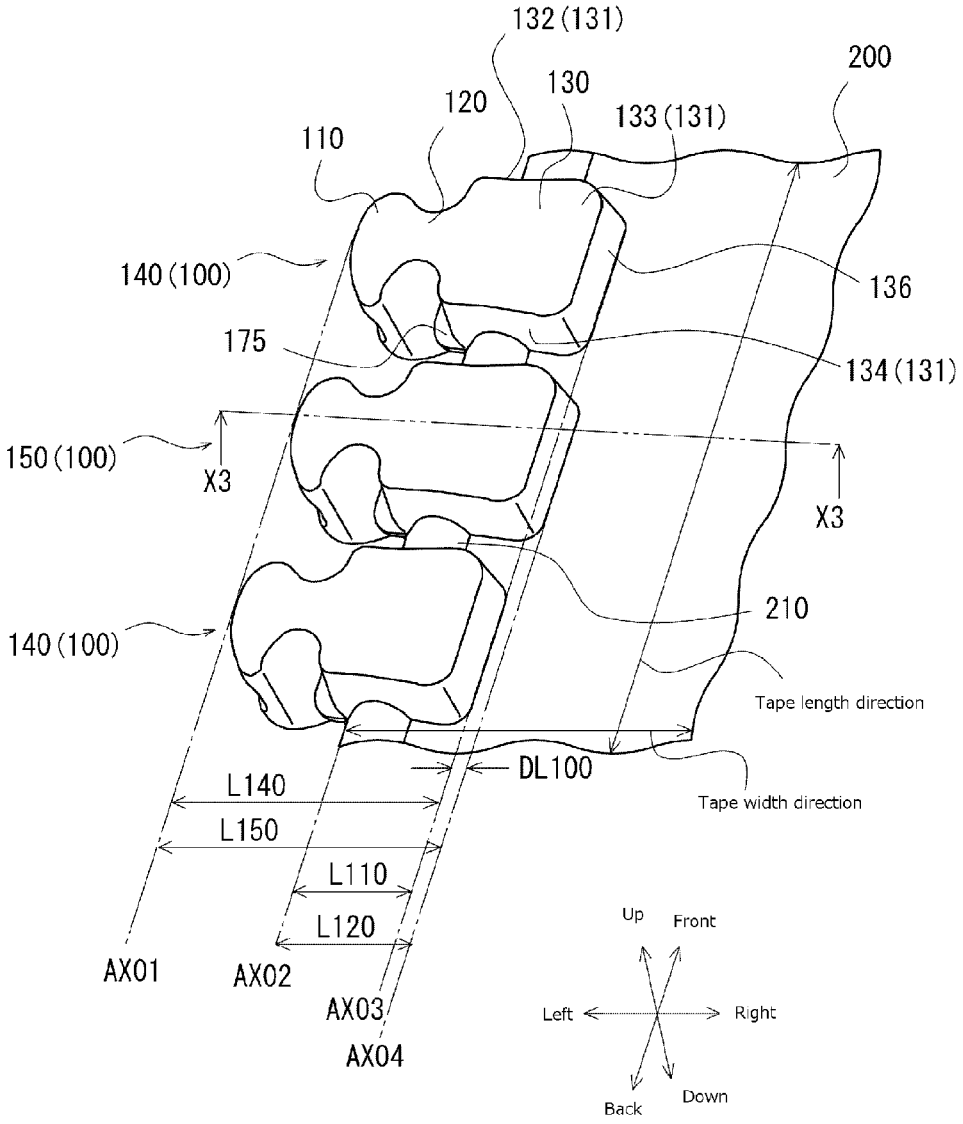
FIG. 2 is a schematic partial perspective view of a fastener stringer of a slide fastener according to a first embodiment of the present invention where a stop element interposed between standard elements is shown at the center in an expanded manner.
Figure 3:
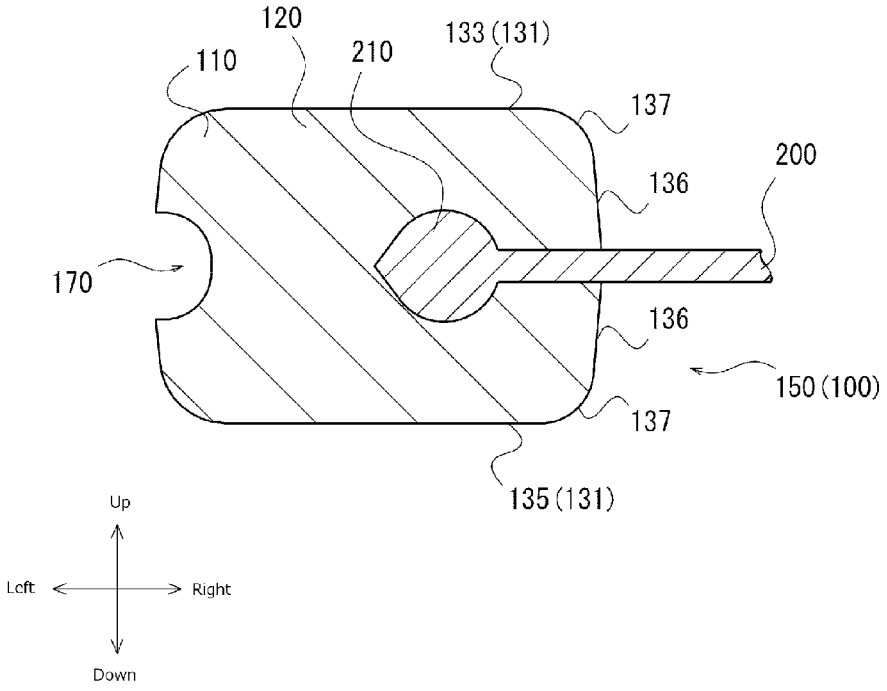
FIG. 3 is a schematic partial sectional view of a fastener stringer of a slide fastener according to a first embodiment of the present invention. In particular.
Figure 4:
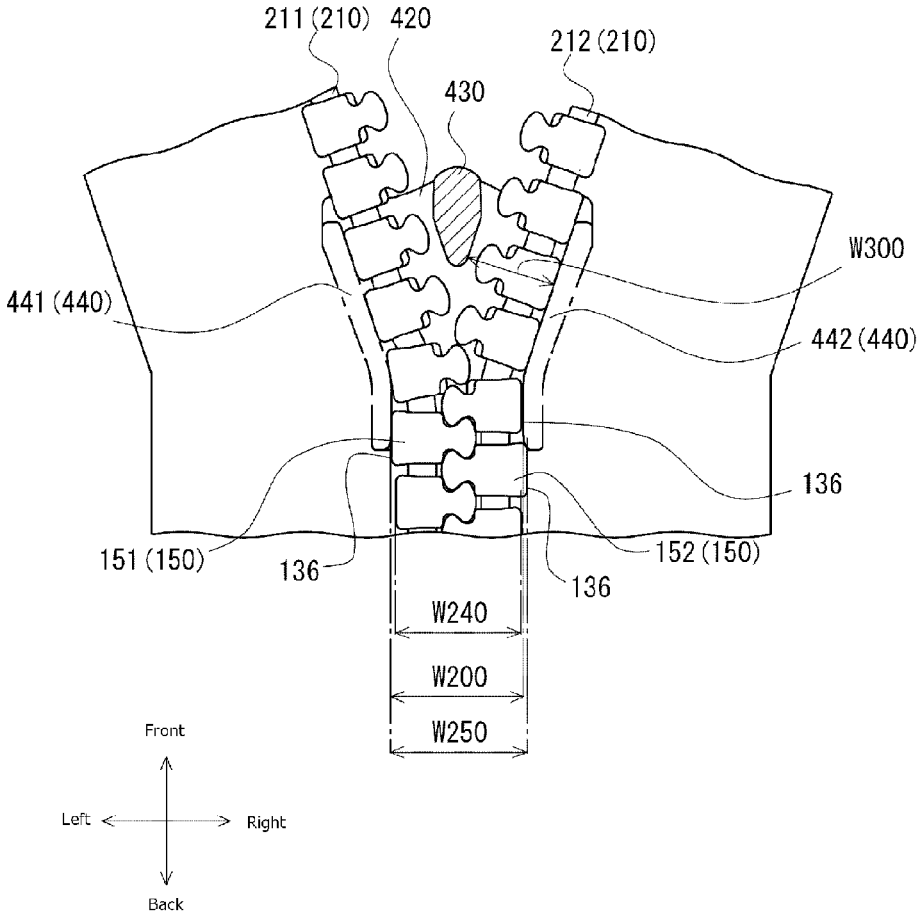
FIG. 4 is a schematic plan view of a slide fastener according to a first embodiment of the present invention, illustrating a state immediately before interlocked two stop elements seen through an upper wing of a slider are pressed into the space between right and left flanges of the slider.
Figure 5:
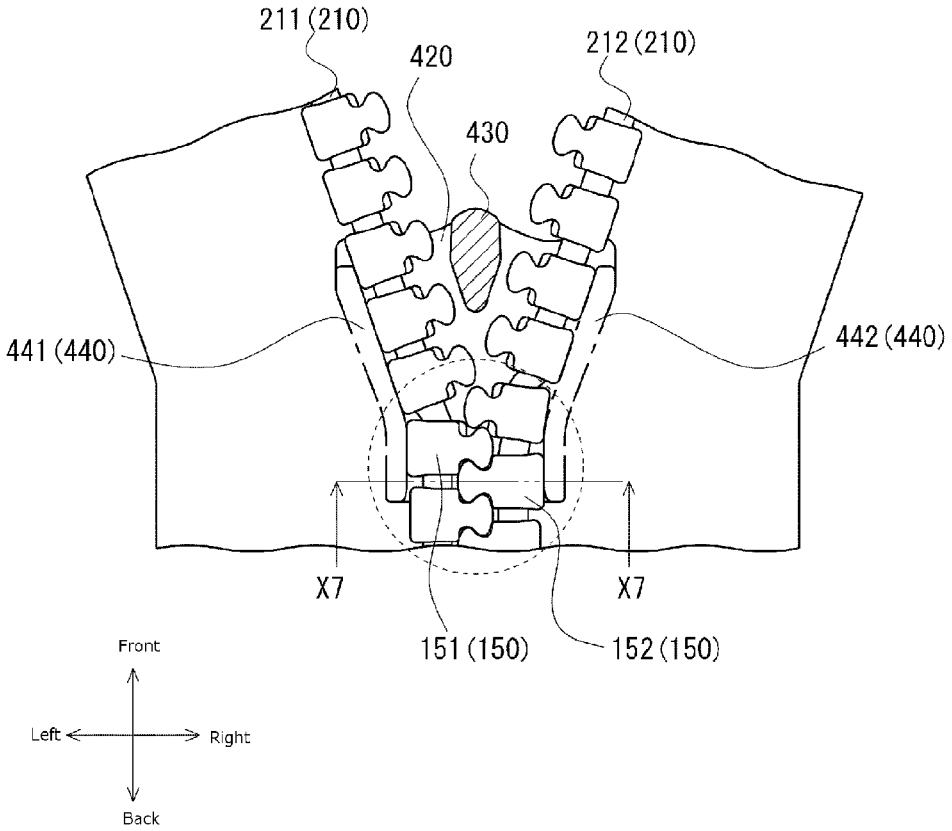
FIG. 5 is a schematic plan view of a slide fastener according to a first embodiment of the present invention, illustrating a state when interlocked two stop elements seen through an upper wing of a slider has been pressed into the space between the right and left flanges of the slider.
Figure 6:
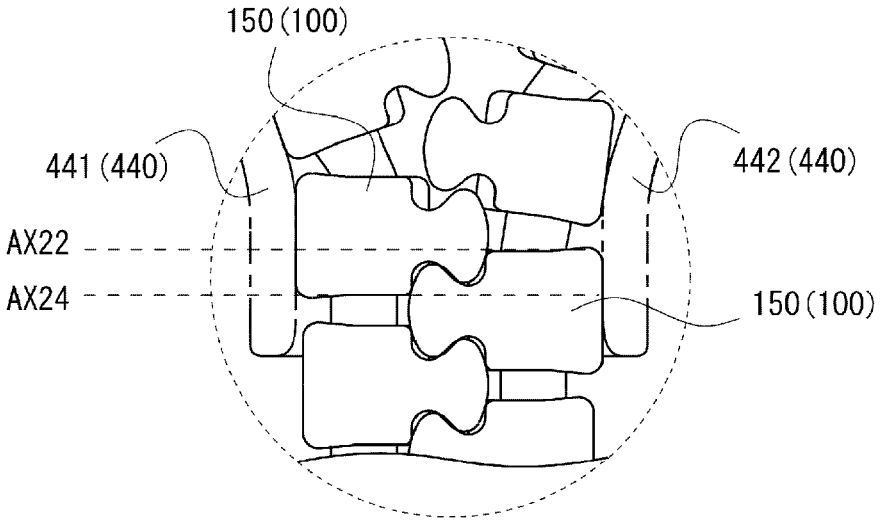
FIG. 6 is a schematic expanded view cut out by a dotted circle in FIG. 5.
Figure 7:
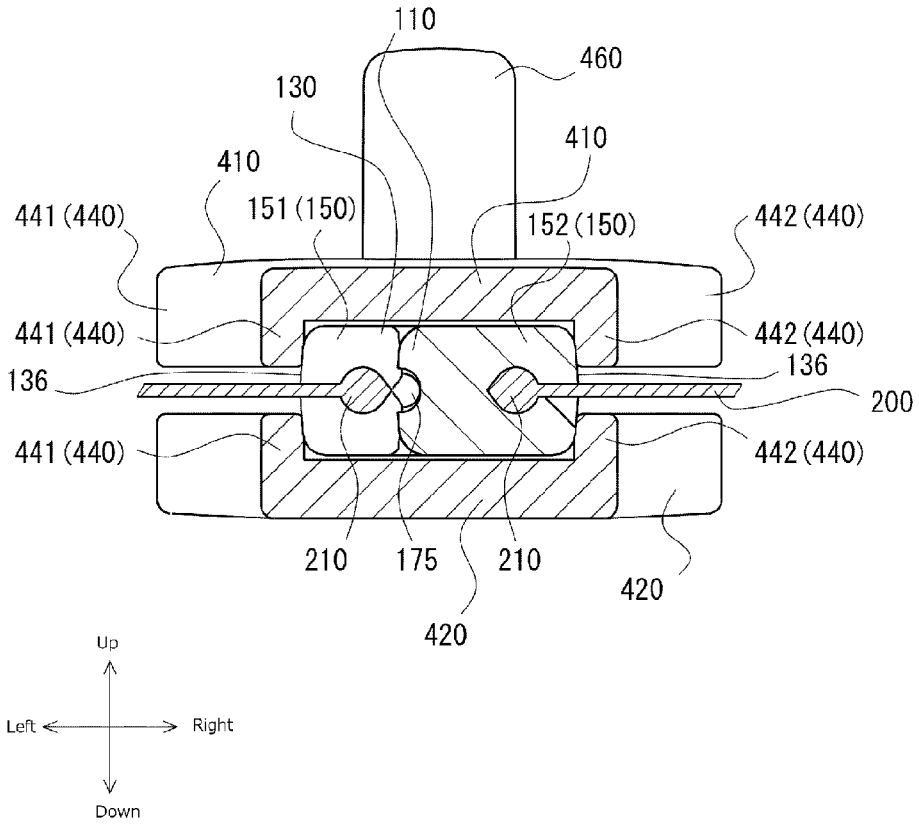
FIG. 7 is a schematic sectional view of a slide fastener along a chain double-dashed line X7-X7 in FIG. 5.

The first embodiment will be explained with reference to FIGS. 1-7. FIG. 1 is a schematic plan view of a slide fastener where 3 lock units each including interlocked two stop element are provided at an intermediate section between the both ends of element rows extending between a front stop and a back stop in which the lock units are arranged in a mutually separated manner. FIG. 2 is a schematic partial perspective view of a fastener stringer of a slide fastener where a stop element interposed between standard elements is shown at the center in an expanded manner. FIG. 3 is a schematic partial sectional view of a fastener stringer of a slide fastener. In particular, FIG. 3 is a schematic sectional view of a stop element in a cross section along a line X3-X3 in FIG. 2. FIG. 4 is a schematic plan view of a slide fastener, illustrating a state immediately before interlocked two stop elements seen through an upper wing of a slider are pressed into the space between right and left flanges of the slider. FIG. 5 is a schematic plan view of a slide fastener, illustrating a state when interlocked two stop elements seen through an upper wing of a slider has been pressed into the space between the right and left flanges of the slider. FIG. 6 is a schematic expanded view cut out by a dotted circle in FIG. 5. FIG. 7 is a schematic sectional view of a slide fastener along a chain double-dashed line X7-X7 in FIG. 5.

A slide fastener 500 has a pair of right and left fastener stringers 300, and a slider 400. Each fastener stringer 300 includes a fastener tape 200 and a plurality of elements 100. It may be noted that an element 100 may be inclusive of a standard element 140 and a stop element 150 as will be explained below. It may also be noted that a first element in Claims may correspond to the standard element (the first element may include the standard element as an example only); a second element in Claims may correspond to the stop element (the second element may include the stop element as an example only).

The slide fastener 500 may be used in various applications such as a garment. Associated front parts of a wind breaker which is one example of the garment can be coupled by the slide fastener 500 and can be opened and closed by manipulating the slide fastener 500. However, the application of the slide fastener should not be limited thereto and it may be utilized for other uses such as a bag use or a pouch use. It is arbitrary how many pieces of slider 400 may be employed. For example, two sliders 400 may be employed for one slide fastener 500 such that a front end of one slider 400 may be touched by/engaged with a front end of another slider 400 by manipulating the two sliders 400. Alternatively, two sliders 400 may be employed for one slide fastener 500 such that a rear end of one slider 400 may be touched by/engaged with a rear end of another slider 400 by manipulating the two sliders 400.

The fastener tape 200 may be a flexible elongated textile or fabric, having a width direction that corresponds or matches the right and left direction shown in FIG. 1 and a length direction that corresponds or matches the front and back direction shown in FIG. 1. The opposed side edge 210 of the fastener tape 200 is provided with an element row 160 that includes a plurality of elements 100 arranged at a regular interval in the length direction of the fastener tape. Each element 100 may be a solid resin part formed by an injection molding and may slightly elastically deform when external force is applied thereto. For example, the elements 100 can be made of various resins such as polyacetal resin, polypropylene resin, polybutylene terephthalate resin, nylon resin, polycarbonate resin and so on. Other material may be employed for the elements 100.

An element row 160, a front stop 160, and a back stop 190 are disposed at the opposed side edge 210 of the fastener tape 200. The front stop 180 is disposed at front-side of the element row 160 and the back stop 190 is disposed at back-side of the element row 160. A core thread may be disposed at the opposed side edge 210 of the fastener tape 200 so that a drop of a resin part such as of the element 100 may be suppressed. It may be noted that "the opposed side edge" is named in light of that a side edge of one fastener tape 200 of the associated fastener tapes 200 is arranged to be opposed to a side edge of another fastener tape 200 of the associated fastener tapes 200. The fastener tape 200 may include an attachment part which corresponds the opposed side edge, and a remaining main part of the fastener tape. In an example, the main part of the fastener tape may be fixed to a garment by sewing.

The back stop 190 may be configured as a separable stop as in the illustrated example and may include an insertion pin 191, a box pin 192, and a box 193. It is possible to insert and pull out the insertion pin 191 into/from the box 193. The slide fastener 500 may be closed by pulling the slider 400 frontward after the insertion pin 191 has been inserted into an element passage in the slider 400 and the space in the box 193. The front stop 180 and the back stop 190 may be made of a resin or a metal. In some embodiment, the front stop 180 and/or the back stop 190 may be omitted.

The element row 160 may include a plurality of standard elements 140 and one or more stop elements 150. It should be noted that the element row 160 does not necessarily have to include both types of the standard element 140 and the stop element 150. As explained in the fourth embodiment, the element row may consist of the stop elements 150 only.

The stop element 150 may be an element/a fastener element that includes a resistance part that contacts the inner surface of the flange 440 of the slider 400 during the slider 400 being slid so that the sliding resistance is increased. On the other hand, the standard element 140 may be an element/a fastener element that does not include such a resistance part. The stop element 150 may be employed to replace the standard element 140 and to be engaged with the corresponding stop element 150 of the other element row 160.

The pair of fastener stringers 300 include the left fastener stringer 301 and right fastener stringer 302. The left fastener stringer 301 includes the left fastener tape 201 and the left element row 161. The left element row 161 includes a plurality of left elements 101. The right fastener stringer 302 includes the right fastener tape 202 and the right element row 162. The right element row 162 includes a plurality of right elements 102. The left element row 161 includes a plurality of left standard elements 141 and one or more left stop elements 151. The right element row 162 includes a plurality of right standard elements 142 and one or more right stop elements 152.

When the right and left fastener stingers 300 are interlocked, the right and left stop elements 150 are engaged, thereby constituting a lock unit 1500. The lock unit 1500 may lock and/or stop the slider 400 so that the slider 400 may be stationary at the lock unit 1500. The lock units 1500 are locally disposed along the interlocked pair of element rows 160. By way of precaution, the lock unit 1500 may temporarily and provisionally lock and/or stop the slider 400. In some embodiments, the lock unit 1500 may be configured such that the sliding of the slider 400 across the lock unit 1500 for opening and closing the slide fastener 500 may not be quite disrupted by the lock unit 1500. The respective lock units 1500 may be spaced so that frontward or backward sliding momentum of the slider 400 may not be greatly weakened. The six or eight or ten or twelve or more right and left elements 100 in total may be provided between the adjacent lock units 1500.

In an embodiment, an interval that is greater than the front and back longitudinal length of the slider 400 may be provided between the adjacent lock units 1500. In an embodiment, the lock unit 1500 may be disposed at the front-side from the middle position along the front and back longitudinal length of the fastener stringer 300.

The slider 400 may be a resin or metal slider that may be slidable along the element row 160. In an embodiment, the slider 400 may be a free slider. The free slider may have a relatively simple structure having no nail that bites into the element row. Therefore, the free slider may be slid along the element row simply by pulling the fastener tape left or right without directly manipulating the slider such as by pulling the pull tab of the slider, for example. In an embodiment, the slider 400 may be made of a metal.

As will be understood by referring to FIGS. 1 and 4, the slider 400 includes an upper wing 410, a lower wing 420, a coupling pillar 430, and a flange 440. The upper wing 410 and the lower wing 420 are arranged to be opposed in up and down direction and which are coupled by the coupling pillar 430 that is provided at the front-side of the slider 400. The slider 400 may, but not necessarily, be colored in some embodiments. For example, the slider 400 may be selectively colored to be white or black. Depending on the color, the slider 400 may be colored through a process during which the slider 400 is thrown into an agitation cistern and agitated for a long period of time in order for the slider 400 to be colored. During this process, the sliders 400 may come into collision with each other or with a wall surface and so on, resulting in variation in the space between the upper wing 410 and the lower wing 420 of the slider 400 among a group of sliders 400. Furthermore, the layer thickness of the color layer made of inorganic pigment and so on which is formed on a surface of the slider may vary in plane.

The flange 440 includes the left flange 441 and the right flange 442. The left flange 441 defines, together with the coupling pillar 430, a travel space for the left element row 161 at the front-side end portion of the slider 400. The right flange 442 defines, together with the coupling pillar 430, a travel space for the right element row 162 at the front-side end portion of the slider 400. The left flange 441 and the right flange 442 are arranged to be opposed at the back-side end portion of the slider 400 to define a travel space for the engaged right and left elements. Y-shaped travel path for elements between the upper wing 410 and the lower wing 420 is configured by the combination of the left flange 441, the right flange 442, and the coupling pillar 430. The front-side end portion of the slider 400 is provided with two mouths for elements. These two mouths are arranged to sandwich the coupling pillar 430. The back-side end portion of the slider 400 is provided with one mouth for elements.

The skilled person in the art will appreciate that the left flange 441 includes the left upper flange coupled to the left edge of the upper wing 410 and the left lower flange coupled to the left edge of the lower wing 420; and similarly the right flange 442 includes the right upper flange coupled to the right edge of the upper wing 410 and the right lower flange coupled to the right edge of the lower wing 420. A left slit for fastener tape through which the left fastener tape travels is defined between the left upper flange and the left lower flange. A right slit for fastener tape through which the right fastener tape travels is defined between the right upper flange and the right lower flange.

As shown in FIG. 2, the element 100 of the standard element 140 or the stop element 150 includes a head 110, a neck 120 and a base 130. The head 110 is coupled to the base 130 via the neck 120. The base 130 of the element 100 is fixed to the opposed side edge 210 of the fastener tape 200, and the neck 120 and the head 110 are positioned outward relative to the opposed side edge 210 of the fastener tape 200. The width of the neck 120 along the length direction of fastener tape is less than the respective widths of the head 110 and the base 130 along the same direction. The width of the base 130 along the length direction of fastener tape is greater than the width of the head 110 along the same direction.

A groove 170 is provided at the outermost/top surface of the head 110 at the middle in thickness of the element 100. The groove 170 extends linearly in the length direction of fastener tape and has two open ends along the length direction of the fastener tape. The element 100 is provided with a pair of projections 175 which are positioned at the middle in thickness of the element 100 and which are arranged to sandwich the neck 120. When the left element 101 and the right element 102 are engaged, the projection 175 of the left element 101 is engaged with/inserted into the groove 170 of the right element 102, and the projection 175 of the right element 102 is engaged with/inserted into the groove 170 of the left element 101 so that the interlocking of the element rows may be strengthened. The thickness direction of the element explained in this paragraph corresponds or matches a direction (i.e. the up and down direction) which intersects the width direction of the fastener tape and the length direction of fastener tape.

As shown in FIGS. 2 and 3, the base 130 of the element 100 includes surfaces 131 extending in the width direction of fastener tape, and an opposite surface 136 to which the surfaces 131 are coupled and with which the width direction of fastener tape intersects. The opposite surface 136 is located at the opposite side of the head 110. The opposite surface 136 may be a surface that extends along the front and back direction/the length direction of the fastener tape. In the present non-limiting example, the surfaces 131 of the base 130 of the element 100 includes 4 surfaces. Specifically, the surfaces 131 of the base 130 includes: (i) an upper surface 133 that is arranged parallel to the main surface of the fastener tape 200, wherein the thickness direction of the element 100 is perpendicular to the upper surface 133; (ii) a lower surface 135 that is located at the opposite side of the upper surface 133; (iii) a front-side surface 132 that is provided perpendicular to the main surface of the fastener tape 200 and couples the upper surface 133 and the lower surface 135 at the front side; and (iv) a back-side surface 134 that couples the upper surface 133 and the lower surface 135 at the back side and is located at the opposite side of the front-side surface 132. The front-side surface 132, the back-side surface 134 and the opposite surface 136 are divided/sectioned by the fastener tape 200 in the up and down direction. The front-side surface 132 and the back side surface 134 are opposed surfaces each of which is opposed to a surface of the adjacent element 100.

The front-side surface 132, the upper surface 133, the back-side surface 134 and the lower surface 135 are coupled to the outer periphery of the opposite surface 136, preferably, via a round rim 137. In some embodiments, the opposite surface 136 may be a flat surface that is not uneven in its entire surface. As shown in FIG. 3, the opposite surface 136 may be inclined such that it extends closer to the head 110 as it extends away from the main surface of the fastener tape 200. When the opposite surface 136 of the stop element 150 is inclined as shown in FIG. 3, the lock unit 1500 can move/displace up and down inside of the slider 400 so that the slider 400 is prevented from being excessively locked by the lock unit 1500. In a case where the surfaces 131 of the base 130 of the stop element 150 are coupled to the opposite surface 136 via the round rim 137, the entering of the engaged two stop elements 150 into the slider 400 may be facilitated.

As described above, each lock unit 1500 for temporarily locking/stopping the slider 400 is formed from the engaged two stop elements 150. The lock units 1500 are locally disposed along the interlocked pair of element rows 160. Each stop element 150 of the lock unit 1500 includes the opposite surface 136 that is arranged farther from the opposed side edge 210 of the fastener tape 200 than the opposite surface 136 of the standard element 140. Accordingly, the right and left width of the engaged two stop elements 150 is greater than the right and left width of the engaged two standard elements 140. It should be noted that the right and left width explained in this paragraph corresponds or matches the width along the width direction of fastener tape (i.e. right and left direction).

In the present non-limiting example, as shown in FIG. 1, the three lock units 1500 are arranged which are captured by the dotted rectangular frames. Each lock unit 1500 includes one left stop element 151 in the left fastener stringer 301 and one right stop element 152 in the right fastener stringer 302. However, in some embodiments, one lock unit 1500 may include one or more pieces of left stop element 151 and one or more pieces of right stop element 152.

As shown in FIG. 2, the opposite surface 136 of the standard element 140 is spaced to have a distance L110 relative to the opposed side edge 210 of the fastener tape 200 and; the opposite surface 136 of the stop element 150 is spaced to have a distance L120 relative to the opposed side edge 210 of the fastener tape 200, where the distance L110<the distance L120 is satisfied. The opposite surface 136 of the stop element 150 is arranged inwardly of the fastener tape 200 compared with the opposite surface 136 of the standard element 140 so that the distance DL100 is set between the respective opposite surfaces 136. In the present example, the core thread exists at the opposed side edge 210, and the relative position of each opposite surface 136 is determined in relation to the position of the core thread that is provided at the outermost of the fastener tape 200. In the present example where the opposite surfaces 136 are inclined, the position of the opposite surface 136 is deemed to be the position where the opposite surface 136 contacts or touches the main surface of the fastener tape 200.

The dashed lines AX01 to AX04 shown in FIG. 2 are parallel to the length direction of fastener tape. The dashed line AX01 is drawn along the (outermost) top positions of the heads 110 arranged along the length direction of fastener tape. The dashed line AX02 is drawn along the outermost position of the opposed side edge 210 which is located at the outermost of the fastener tape 200. The dashed line AX03 is drawn along the positions where the opposite surfaces 136 of the standard elements 140 touch the main surface of the fastener tape 200. The dashed line AX04 is drawn along the positions where the opposite surfaces 136 of the stop elements 150 touch the main surface of the fastener tape 200.

As shown in FIG. 2, the length L150 of the stop element 150 along the width direction of fastener tape is greater than the length L140 of the standard element 140 along the width direction of fastener tape. It is envisaged that the length of the neck 120 or the head 110 outwardly extending relative to the opposed side edge 210 can be increased so that the length L140 becomes greater than the length L150. However, such an arrangement may invite unnecessary widened gap between the parallel core threads when elements are engaged and may not be suitable.

The opposite surface 136 of the stop element 150 may be a flat surface at least in an area where it comes into contact with the inner surface of the flange 440 of the slider 400, preferably across its entire surface. If the opposite surface 136 is formed to be uneven non-flat surface, the bumps on the opposite surface 136 may come into contact with the inner surface of the flange 440 and thereby may be worn, possibly resulting in that the position of the opposite surface 136 may be displaced outwardly of the fastener tape during its use. The opposite surface 136 may be a pearskin finished surface. Alternatively, the opposite surface 136 may be a mirror finished surface, facilitating the engaged pair of stop elements 150 being pressed into the slider 400. Any methods for the mirror finish may be employed and, for example, any abrasives may be utilized to flatten the surface.

As shown in FIG. 4, the right and left width W250 of the engaged pair of stop elements 150 is greater than the right and left width W240 of the engaged pair of standard elements 140. Comparing with the space W200 between the opposed left flange 441 and the right flange 442 at the back-side end portion of the slider 400, the right and left width W250> space W200> the right and left width W240 is satisfied. The opposite surface 136 of the stop element 150 is displaced inwardly of the fastener tape 200 relative to the opposite surface 136 of the standard element 140 so that the slight difference between the right and left width W240 and the right and left width W250 is produced. The space W200 may be a minimum space between the right and left flanges 440.

For coloring the sliders, a number of sliders may be thrown into the agitation cistern and be agitated for a predetermined period of time so that a color layer is formed on a surface of the slider. However, during this process, external force may be applied to the slider to possibly deform the slider; the space between the upper wing and the lower wing may possibly be varied among a group of sliders, for example. Moreover, the thickness of the color layer made of inorganic pigment formed on the surface of the slider may be varied among a group of sliders.

Even studying the patent literature 1 and pressing the stop element into the space between the upper wing and the lower wing, the above-explained variation may affect the locking power/locking capability of the lock unit and may cause variation on the locking power/locking capability. For example, the locking power of one lock unit of one slide fastener may be different from the locking power of another lock unit of another slide fastener. Under some occasions, a number of slide fasteners which do not allow smooth opening simply by pulling the fastener tape left or right may be produced, deteriorating its yield.

The present inventor has newly discovered that, even processed through the coloring step, the variation in the space between the right and left flanges at the back-side end portion of the slider is less than the variation in the space between the upper wing and the lower wing. Even studying the patent literature 1, in particular its FIG. 5, the projection may be broken by external force, and still the projection may be worn by the repeated contact with the sliding slider. Clearly, there is a problem of durability of locking by the lock unit.

If the projection height of the projection was increased to compensate for the decreased height due to the wear, the initial locking power of the lock unit will be increased accordingly, making it difficult to smoothly open the slide fastener 500 simply by pulling the fastener tape 200 right or left without directly manipulating the pull tab 470 of the slider 400 such as pulling the pull tab 470; the durability of the locking power against the wear may be improved though. Accordingly, "soft-locking" for the slider at the stop element/lock unit may not be achievable.

Based on the above-explained considerations, the present inventor has found the followings: the position of the opposite surface 136 of the stop element 150 may be slightly regulated so that the slide fastener 500 having the lock unit 1500 with the stabilized locking power can be produced. The soft locking of the slider 400 by the lock unit 1500 may be achieved without excessively strengthening the locking power of the lock unit 1500 for the slider 400. This may be particularly preferable if the sliders 400 are to be colored, this should not be a limitation though.

It may be noted that the length L140 of the standard element 140 and the length L150 of the stop element 150 shown in FIG. 2 are less than the minimum space W300 between the flange 440 and the coupling pillar 430 shown in FIG. 4. The locking function of the lock unit 1500 may be formed and activated when the pair of stop element 150 are engaged.

FIG. 4 illustrates a view in which a portion larger than the front side half of the left stop element 151 has entered into the space between the right and left flanges 440 and the rim 137 between the side surface 131 and the opposite surface 136 of the right stop element 152 has contacted the back-side end portion of the right flange 442. At this moment, the pair of the engaged stop elements 150 has not been pressed into the space between the right and left flanges 440, indicating "an unlocked condition" or "a condition immediately before the locking".

FIG. 5 illustrates that the whole of the left stop element 151 has entered into the space between the right and left flanges 440, and the front side most part of the right stop element 152 has entered into the space between the right and left flanges 440, indicating a condition where the pair of the stop elements 150 has been pressed into the space between the right and left flanges 440, i.e. "locked condition".

When transiting from the unlocked condition to the locked condition, the opposite surface 136 of the stop element 151 touches the inner surface of the left flange 441 widely. Thus, the right stop element 152 may smoothly enter into the space between the right and left flanges 440 according to the pulling force applied for the slider 400, securing stable movement of the stop element pressed into the space between the flanges.

As shown in FIG. 6, when the pair of stop elements 150 has been pressed into the space between the right and left flanges 440 at the back-side end portion of the slider 400, the opposite surface 136 of the left stop element 151 and the opposite surface 136 of the right stop element 152 partially overlap with each other. The opposite surface 136 of the left stop element 151 and the opposite surface 136 of the right stop element 152 overlap with each other between the dashed line AX22 and the dashed line AX24 which are running in parallel along the width direction of fastener tape.

According to such an arrangement, the overlapped range of the pair of right and left stop elements 150 may be sandwiched by the right and left flanges 440, securing enough engagement of the pair of the stop elements. Further, as shown in FIG. 7, enough elastic deformation of the contacted portions at the base 130 of the left stop element 151 and the head 110 of the right stop element 152 may be achieved, and thus the stop element 150 can be pressed into the space between the right and left flanges 440 without highly depending on the elastic deformation of the contacted portions of the respective opposite surfaces 136 of the respective stop elements 150 with the respective flanges 440. Additionally, the above-described head 110 is provided with the groove 170 so that the elastic deformation around the head 110 may be secured or facilitated.

As illustrated in the section of FIG. 7, the stop element 150 is not pressed into the space between the upper wing 410 and the lower wing 420, providing slight gap relative to the respective upper wing 410 and lower wing 420 and allowing up and down movement of the stop element 150 between the upper wing 410 and the lower wing 420. In this embodiment, the thickness of the stop element 150 is not increased compared to the thickness of the standard element 140 in order to constitute a lock unit. The variation may possibly be caused in the space between the upper wing 410 and the lower wing 420 of the slider 400 during the coloring process for sliders. The stop element 150 can be movable between the upper wing 410 and the lower wing 420, and thus the variation of the locking power of the lock unit due to the above-explained variation will be avoided.

If the stop element having the projection was disposed at the element row of the slide fastener as described in the patent literature 1, the appearance of the slide fastener may be deteriorated due to the stop element presenting a different appearance compared to that of the standard element. In contrast, in this embodiment, the appearance of the stop element 150 is quite similar to that of the standard element 140 which may be beneficial for slide fasteners used in the field of goods where high priority is placed on a design such as garments and bags, achieving indispensable effect from a stand point of appearance.

The Second Embodiment

Figure 8:
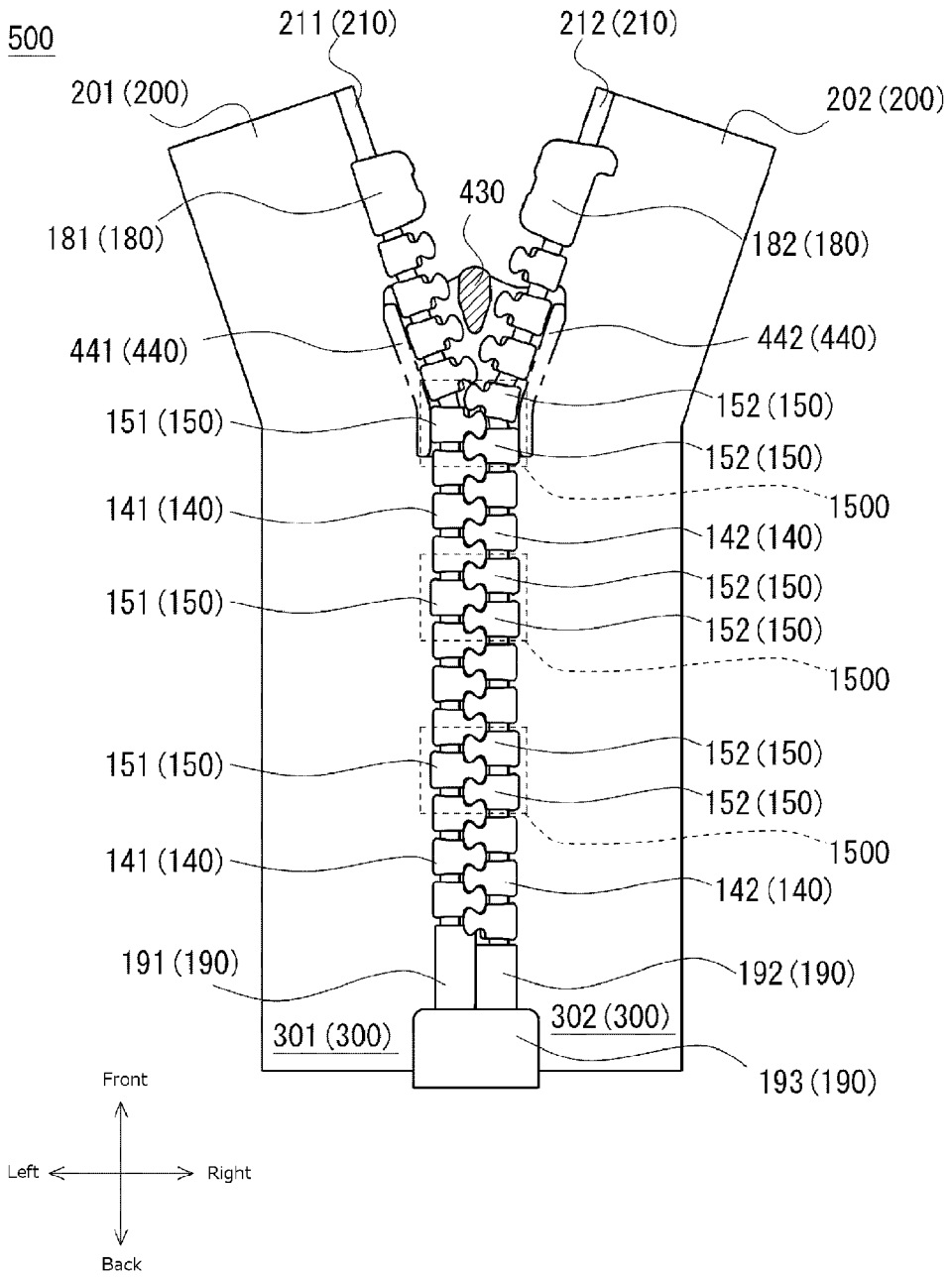
FIG. 8 is a schematic plan view of a slide fastener according to a second embodiment of the present invention, illustrating an example where each lock unit includes three stop elements.

The second embodiment will be described with reference to FIG. 8. FIG. 8 is a schematic plan view of a slide fastener, illustrating an example where each lock unit includes three stop elements. In this embodiment, each lock unit 1500 includes three stop elements 150 in total. As shown in FIG. 8, the lock unit 1500 includes one left stop element 151 at the left fastener stringer 301 and two right stop elements 152 at the right fastener stringer 302. Even in such a case, similar or the same effect may be achieved as explained in the first embodiment.

With respect to the number of stop element 150 included in one lock unit 1500, four stop elements 150 may be preferable and three stop elements 150 may be more preferable. In such a case, the locking power of the lock unit 1500 may be set to be such a degree not to decrease the momentum of the sliding slider 400. That is, when the slider 400 is slid backward in order to open the slide fastener 500, it may be not preferable for the sliding slider 400 to be forced to be stopped. If more and more stop elements 150 are included in one lock unit 1500, the possibility for the slider 400 sliding backward to be stopped may increase. In view of this, the number of the stop element 150 included in one lock unit 1500 may be equal to or less than 4, and more preferably equal to or less than 3. It should be noted that the number of stop element 150 included in one lock unit 1500 may be equal to or more than 5 as in the third embodiment.

The Third Embodiment

Figure 9:
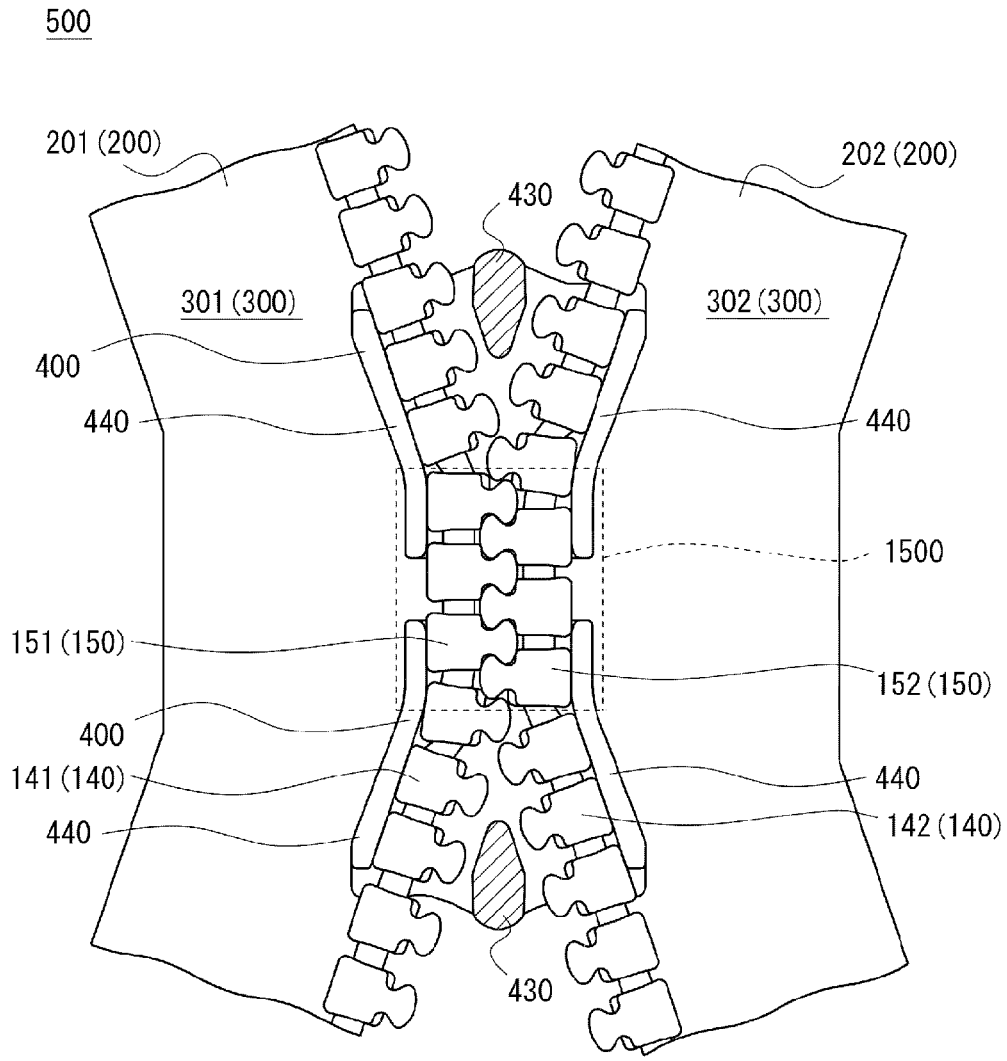
FIG. 9 is a schematic plan view of a slide fastener according to a third embodiment of the present invention, illustrating right and left fastener stringers being engaged at a lock unit including six interlocked stop elements in total.

The third embodiment will be described with reference to FIG. 9. FIG. 9 is a schematic plan view of a slide fastener, illustrating right and left fastener stringers being engaged at a lock unit including total six interlocked stop elements.

In the present embodiment, opening and closing of the slide fastener 500 is controlled by front and back two sliders 400, and one common lock unit 1500 is provided for the front and back two sliders 400. Even in such an embodiment, similar or the same effect may be achieved as in the above-explained embodiments. Any number, including two or more of the sliders may be employed in one slide fastener. One lock unit 1500 may be disposed not only for one slider 400 but also for two or more sliders 400.

In particular, the one lock unit 1500 commonly used by a plurality of sliders 400 may preferably include four or more stop elements 150, and more preferably six or more stop elements 150. If the number of stop elements 150 included in one lock unit 1500 increases, the lock unit 1500 may be reinforced and thus enough power thereof for stopping the plurality of sliders 400 may be obtained.

In an example shown in FIG. 9, if the front and back two sliders 400 get closer and then the right and left fastener stringers 300 are opened; and if the front and back two sliders 400 get away from each other and then the right and left fastener stringers 300 are closed. The lock unit 1500 may be disposed at a stop position for the front and back two sliders 400 which are closely arranged to open the right and left fastener stringers 300.

In an example shown in FIG. 9, the front-side slider 400 is locked by the front-side two stop elements 150 of the lock unit 1500 and the free frontward or backward movement of that slider 400 is prevented. The back-side slider 400 is locked by the back-side two stop elements 150 of the lock unit 1500 and the free frontward or backward movement of that slider 400 is prevented. The mechanism of the lock unit 1500 for locking the slider 400 is similar to the above embodiments, and thus duplicative descriptions shall be omitted.

In one embodiment, the back-side slider 400 may move frontward across the lock unit 1500, and similarly the front-side slider 400 may move backward across the lock unit 1500. It may be noted that if the longitudinal front and back length of the lock unit 1500 is to be elongated greatly, quite strong force may be required for manipulating the slider as explained above in this paragraph. Thus, in order to secure a degree of freedom for the manipulating manner of the slide fastener 500, the number of stop elements 150 included in one lock unit 1500 may be equal to or less than 10, and may occasionally be equal to or less than 8.

The Fourth Embodiment

Figure 10:
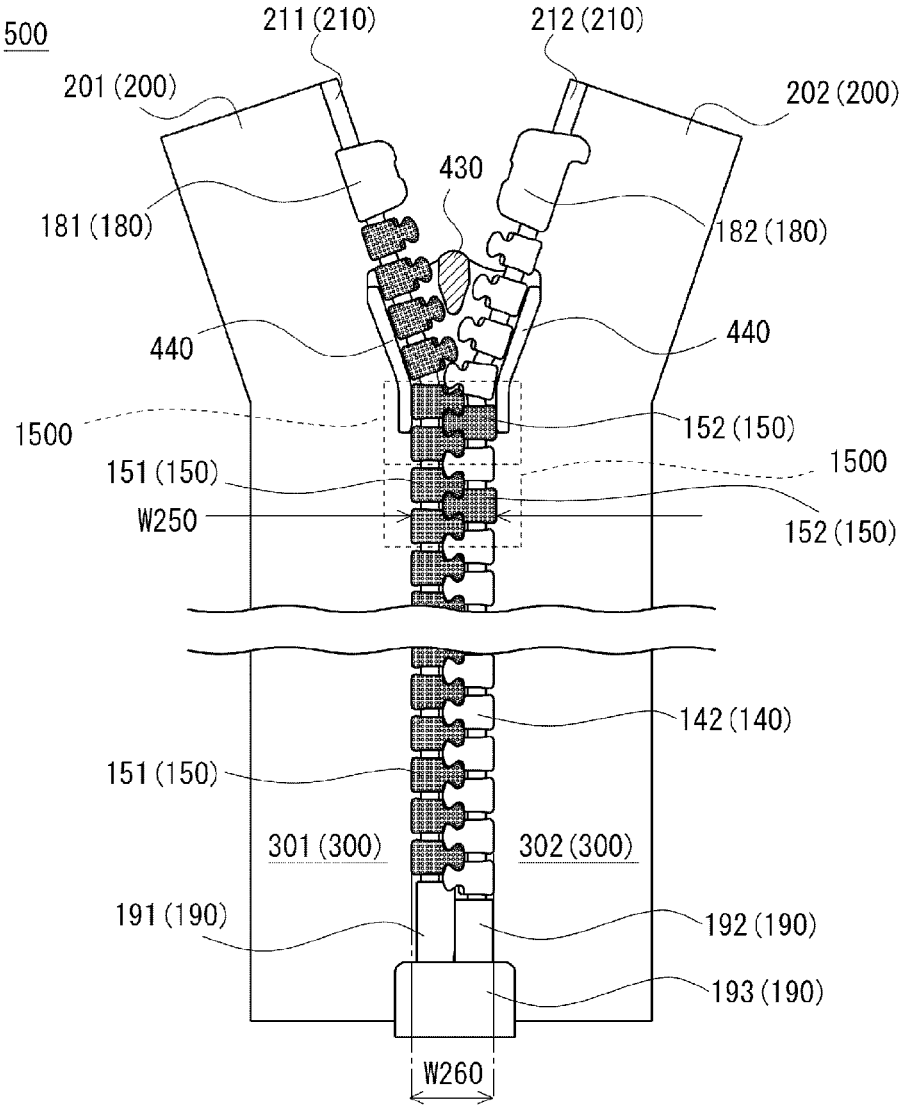
FIG. 10 is a schematic plan view of a slide fastener according to a fourth embodiment of the present invention where all elements in a left element row are stop elements and, on the other hand, elements except for two stop elements in a right element row are standard elements.

The fourth embodiment will be described with reference to FIG. 10. FIG. 10 is a schematic plan view of a slide fastener where all elements in a left element row are stop elements and, on the other hand, elements except for two stop element in a right element row are standard elements. In FIG. 10, the stop elements are decorated with pattern so that the stop elements are distinguishable from the standard elements.

In this embodiment, one of the pair of right and left element rows is configured to include the stop elements 150 only, and the other element row is configured to include one or more stop elements 150 locally disposed along the row of the standard elements 140. If the standard element 140 and the stop elements 150 have different appearances, the position of the lock unit 1500 will be readily noticeable, facilitating its proper use.

For example, the stop elements 150 may be colored black, and the standard element 140 may be colored white. In this case, the black stop elements 150 locally disposed among the white standard elements 140 at one of the pair of the right and left element rows will be visible, and that black stop elements 150 will collaborate with the black stop elements 150 at the other element row, thereby the lock unit 1500 being configured. Almost anyone may readily understand that the lock unit 1500 has been intentionally provided in order to serve for the user's convenience.

In an example shown in FIG. 10, the left element row of the left fastener stringer 301 is configured by the stop elements 150 only. The right element row of the right fastener stringer 302 is mainly configured by the standard elements 140 and in which the stop elements 150 are locally disposed. The stop elements 150 may be decorated and thus it is readily identified in contrast with the standard elements 140. Not necessarily limited to a color or pattern, a degree of reflection at the surface of the elements may be changed. Thus, the appearance of the stop elements 150 could differ from that of the standard elements 140 in any manner. It may be noted that the element row having the stop elements 150 only may be placed right but left.

As shown in FIG. 10, the right and left width W250 of the engaged right and left stop elements 150 is greater than the right and left width W260 of the engaged right and left stop element 150 and the standard element 140. Comparing with the space W200 between the left flange 441 and the right flange 442 which are opposed at the rear end portion of the slider 400 shown in FIG. 4, W250>W200 is satisfied, and W200>W260 is satisfied. Therefore, the smooth sliding of the slider 400 at the external of the lock unit 1500 and the locking of the slider 400 by the lock unit 1500 are compatible.

In an example shown in FIG. 10, one standard element 140 is interposed between the two right stop elements 150. When the slider 400 is slid backward to open the slide fastener 500, the front-side lock unit 1500 may serve to decelerate the movement of the slider 400 and rear-side lock unit 1500 may serve to stop the slider 400, for example. The number of standard elements 140 interposed between the stop elements 150 should not be limited to one, but maybe two or more. One to four stop elements 150 may be interposed between the stop elements 150 in an exemplary envisaged embodiment.

Figure 11:
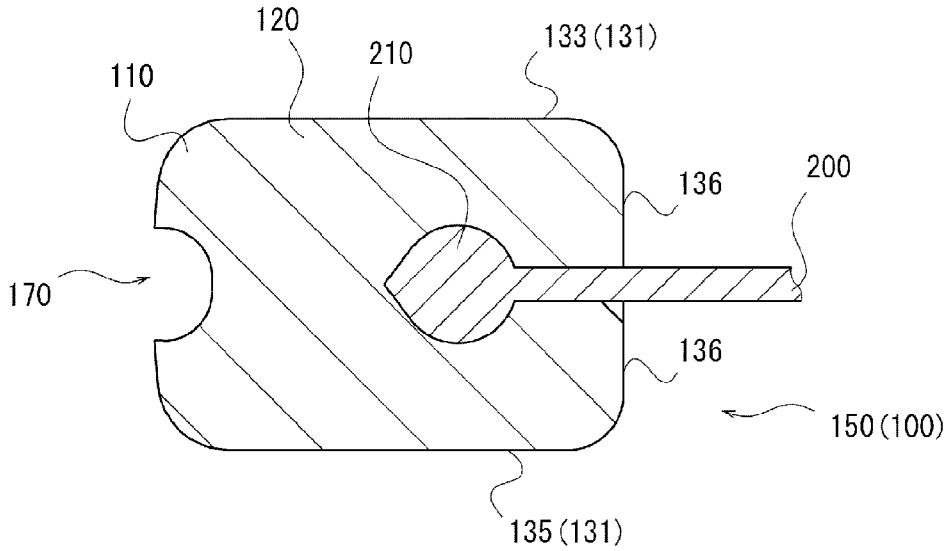
FIG. 11 is a partial sectional view of a fastener stringer of a slide fastener according to a modified example of the present invention, FIG. 11 corresponding to FIG. 3.

Lastly, a modified example will be described with reference to FIG. 11. FIG. 11 is a partial sectional view of a fastener stringer of a slide fastener, FIG. 11 corresponding to FIG. 3. In this modified example, the opposite surface 136 of the stop elements 150 is arranged to be perpendicular to the main surface of the fastener tape 200. Even in this case, similar or the same effect may be achieved as explained in the above embodiments. The contacted area of the opposite surface 136 with the inner surface of the flange 440 of the slider 400 may increase, and thus the locking power of the lock unit 1500 may increase. The standard element 140 may be configured similarly with the stop elements 150 explained in this paragraph.

In light of the above descriptions, the skilled person in the art may foresee that various modifications may be made on the respective embodiments. A fin portion may be provided on the opposite surface 136 of the element 100 which is to be inserted between the upper flange coupled to the upper wing 410 and the lower flange coupled to the lower wing 420. The lock unit 1500 may be configured by any number of engaged two or more stop elements 150. For example, four or five stop elements 150 may serve together to constitute the lock unit 1500. Any number of lock unit 1500 may be disposed in one slide fastener 500. Any locking power may be set for the lock unit 1500 and should not be limited to the soft-locking explained in this specification.

What is claimed is:

1. A slide fastener comprising:

a first fastener stringer that comprises a first element row and a first fastener tape, the first element row including a plurality of first elements and one or more second elements, and the first element row being disposed at an opposed side edge of the first fastener tape;

a second fastener stringer that comprises a second element row and a second fastener tape, the second element row including a plurality of first elements and one or more second elements, and the second element row being disposed at an opposed side edge of the second fastener tape; and a slider that is slidable along the first and second element rows of the first and second fastener stringers, wherein each of the first elements and the second elements includes a head coupled to a base via a neck, the base including an opposite surface that is located at an opposite side of the head, and the opposite surface of the one or more second elements is positioned farther from the opposed side edge than the opposite surface of the first elements in the first fastener stringer or the second fastener stringer when the first and the second fastener elements are aligned with respect to the fastener tape, and at least two engaged second elements of the first and second element rows constitute a lock unit that is for locking the slider.

2. The slide fastener according to claim 1, wherein a total width of the engaged second elements included in the lock unit is greater than a total width of engaged first elements or a total width of engaged first and second elements;

wherein a minimum space between a pair of flanges of the slider is greater than the total width of the engaged first elements or the total width of the engaged first and second elements; and wherein the total width of the engaged second elements included in the lock unit is greater than the minimum space between the pair of flanges of the slider.

3. The slide fastener according to claim 1, wherein the opposite surface of each of the engaged second elements is formed to be substantially flat in its entire surface.

4. The slide fastener according to claim 1, wherein the opposite surfaces of the at least two engaged second elements touch inner surfaces of a pair of flanges of the slider while said at least two engaged second elements have been pressed into a space between the pair of flanges of the slider, said opposite surfaces respectively touching the inner surfaces face opposite directions in a partially overlapped manner.

5. The slide fastener according to claim 1, wherein the at least two engaged second elements are movable in a space between an upper wing and a lower wing of the slider while the at least two engaged second elements are pressed into the space between a pair of flanges of the slider.

6. The slide fastener according to claim 1, wherein the opposite surface of each of the engaged second elements is inclined such that the opposite surface extends closer to the head of the second element as the opposite surface extends away from the main surface of the fastener tape.

7. The slide fastener according to claim 1, wherein the opposite surface of each of the engaged second elements is mirror finished.

8. A slide fastener comprising:

a first fastener stringer that comprises a first element row and a first fastener tape, the first element row including a plurality of first elements and one or more second elements, and the first element row being disposed at an opposed side edge of the first fastener tape;

a second fastener stringer that comprises a second element row and a second fastener tape, the second element row including a plurality of first elements and one or more second elements, and the second element row being disposed at an opposed side edge of the second fastener tape; and a slider that is slidable along the first and second element rows of the first and second fastener stringers, wherein each of the first elements and the second elements includes a head coupled to a base via a neck, the base including an opposite surface that is located at an opposite side of the head, wherein the opposite surface of the one or more second elements is positioned farther from the opposed side edge than the opposite surfaces of the first elements in the first fastener stringer or the second fastener stringer, and at least two engaged second elements of the first and second element rows constitute a lock unit for locking the slider, wherein a total width of the engaged second elements included in the lock unit is greater than a total width of engaged first elements or a total width of engaged first and second elements;

wherein a minimum space between a pair of flanges of the slider is greater than the total width of the engaged first elements or the total width of the engaged first and second elements; and wherein the total width of the engaged second elements included in the lock unit is greater than the minimum space between the pair of flanges of the slider.

9. The slide fastener according to claim 8, wherein the opposite surface of each of the engaged second elements is formed to be substantially flat in its entire surface.

10. The slide fastener according to claim 8, wherein the opposite surfaces of the engaged second elements touch inner surfaces of the pair of flanges of the slider while the engaged second elements are pressed into a space between the pair of flanges of the slider, and the opposite surfaces touching the inner surfaces face opposite directions in a partially overlapped manner.

11. The slide fastener according to claim 8, wherein the engaged second elements are movable in a space between an upper wing and a lower wing of the slider while the engaged second elements are pressed into a space between the pair of flanges of the slider.

12. The slide fastener according to claim 8, wherein the opposite surface of each of the engaged second elements is inclined such that the opposite surface extends closer to the head of the second element as the opposite surface extends away from a main surface of the fastener tape.

13. The slide fastener according to claim 8, wherein the opposite surfaces of the engaged second elements are mirror finished.

14. A slide fastener comprising:

a first fastener stringer that comprises a first element row and a first fastener tape, the first element row including a plurality of first elements and one or more second elements, and the first element row being disposed at an opposed side edge of the first fastener tape;

a second fastener stringer that comprises a second element row and a second fastener tape, the second element row including one or more second elements, and the second element row being disposed at an opposed side edge of the second fastener tape; and a slider that is slidable along the first and second element rows of the first and second fastener stringers, wherein each of the first elements and the second elements includes a head coupled to a base via a neck, the base including an opposite surface that is located at an opposite side of the head, and the opposite surface of the one or more second elements is positioned farther from the opposed side edge of the first fastener tape than the opposite surfaces of the first elements in the first fastener stringer, and at least two engaged second elements of the first and second element rows constitute a lock unit that is for locking the slider wherein the opposite surfaces of the engaged second elements touch inner surfaces of a pair of flanges of the slider while the engaged second elements are pressed into a space between the pair of flanges of the slider, and the opposite surfaces of the engaged second elements touching the inner surfaces face opposite directions in partially overlapped manner.

15. The slide fastener according to claim 14, wherein the opposite surface of each of the engaged second elements is formed to be substantially flat in its entire surface.

16. The slide fastener according to claim 14, wherein the engaged second elements are movable in a space between an upper wing and a lower wing of the slider while the engaged second elements are pressed into the space between the pair of flanges of the slider.

17. The slide fastener according to claim 14, wherein the opposite surface of each of the engaged second elements is inclined such that the opposite surface extends closer to the head of the second element as the opposite surface extends away from the main surface of the fastener tape.

18. The slide fastener according to claim 14, wherein the opposite surfaces of the engaged second elements are mirror finished.

* * * * *